US007726131B2

(12) United States Patent
Sze et al.

(10) Patent No.: US 7,726,131 B2
(45) Date of Patent: Jun. 1, 2010

(54) FLOATWALL DILUTION HOLE COOLING

(75) Inventors: Robert Sze, Mississauga (CA); Jeffrey Richard Verhiel, Toronto (CA)

(73) Assignee: Pratt & Whitney Canada Corp., Longueuil (CA)

( * ) Notice: Subject to any disclaimer, the term of this patent is extended or adjusted under 35 U.S.C. 154(b) by 752 days.

(21) Appl. No.: 11/641,115

(22) Filed: Dec. 19, 2006

(65) Prior Publication Data

US 2008/0264064 A1 Oct. 30, 2008

(51) Int. Cl.
*F23R 3/06* (2006.01)

(52) U.S. Cl. ..... 60/754; 60/755; 60/757

(58) Field of Classification Search ..... 60/804, 60/755, 757, 754
See application file for complete search history.

(56) References Cited

U.S. PATENT DOCUMENTS 3,965,066 A * 6/1976 Sterman et al. ..... 60/757
4,064,300 A * 12/1977 Bhangu ..... 60/757
4,302,941 A 12/1981 DuBell
4,567,730 A * 2/1986 Scott ..... 60/757
4,628,694 A * 12/1986 Kelm et al. ..... 60/752
4,653,279 A 3/1987 Reynolds
4,695,247 A * 9/1987 Enzaki et al. ..... 60/757
5,012,645 A 5/1991 Reynolds
5,542,246 A 8/1996 Johnson et al.
6,000,908 A * 12/1999 Bunker ..... 60/752
6,408,629 B1 6/2002 Harris et al.
6,860,108 B2 * 3/2005 Soechting et al. ..... 60/755
6,973,419 B1 12/2005 Fortin et al.
7,464,554 B2 * 12/2008 Cheung et al. ..... 60/754
2003/0213250 A1 * 11/2003 Pacheco-Tougas et al. .... 60/752
2004/0250548 A1 * 12/2004 Howell et al. ..... 60/796
2005/0022531 A1 * 2/2005 Burd ..... 60/752

* cited by examiner

*Primary Examiner*—Ted Kim
(74) *Attorney, Agent, or Firm*—Ogilvy Renault LLP

(57) ABSTRACT

A combustor for a gas turbine engine is provided, the combustor having an outer shell with an outer surface exposed to cooling air and an inner surface, and at least one floatwall panel attached to the inner surface of the outer shell and having a trailing edge. At least one dilution hole is in the floatwall panel near the trailing edge and in communication with the outer surface of the outer shell, and at least one local air impingement hole is in the outer shell downstream of each at least one dilution hole, that directs the cooling air towards the trailing edge of the floatwall panel.

12 Claims, 3 Drawing Sheets

FLOATWALL DILUTION HOLE COOLING

TECHNICAL FIELD

The invention relates to combustors having a combustor chamber liner arrangement comprising floatwall panels.

BACKGROUND OF THE ART

In a combustor having a combustion chamber liner arrangement comprising floatwall panels, the combustor comprises an outer shell, which is lined on the inside with heat shields, referred to herein as floatwall panels. One example of such an arrangement is disclosed in U.S. Pat. No. 4,302,941. Each floatwall panel is attached to the outer shell with studs and nuts. The middle stud and the corresponding hole on the shells are made to tight tolerance to locate the floatwall. The rest of the studs and holes are loosely made to allow freedom of movement.

In certain arrangements, there are dilution holes near the trailing edge of the floatwall panel, which communicate with corresponding dilution holes in the outer shell and allows cooling air to dilute the hot gas. In addition to dilution holes, the outer shell also has smaller air impingement holes to allow cooling air to enter between the floatwall panel and the outer shell, in order to cool the back of the floatwall panel. This cooling air exits the effusion holes on the surface of the floatwall panel and forms a film on the surface of the floatwall panel.

Establishing and maintaining a film of cooling air along the inside surface of the floatwall panel helps to form a barrier against thermal damage to the floatwall panel. Challenges in the floatwall arrangement include the need to purge hot gas from between the floatwall panel and the outer shell, and the need to maintain the film of cooling air beyond the trailing edge of the floatwall panel to cool the region behind the dilution holes.

Features that distinguish the present invention from the background art will be apparent from review of the disclosure, drawings and description presented below.

DISCLOSURE OF THE INVENTION

One aspect of the invention provides a combustor comprising an outer shell having an outer surface exposed to cooling air and an inner surface, and at least one floatwall panel. At least one dilution hole is in the floatwall panel near the trailing edge and in communication with the outer surface of the outer shell, and at least one local air impingement hole is in the outer shell downstream of each at least one dilution hole, that directs the cooling air towards the trailing edge of the floatwall panel.

Another aspect of the invention provides a gas turbine engine having a combustor as described above.

DESCRIPTION OF THE DRAWINGS

In order that the invention may be readily understood, embodiments of the invention are illustrated by way of example in the accompanying drawings.

Further details of the invention and its advantages will be apparent from the detailed description included below.

DETAILED DESCRIPTION OF PREFERRED EMBODIMENTS

Figure 1:
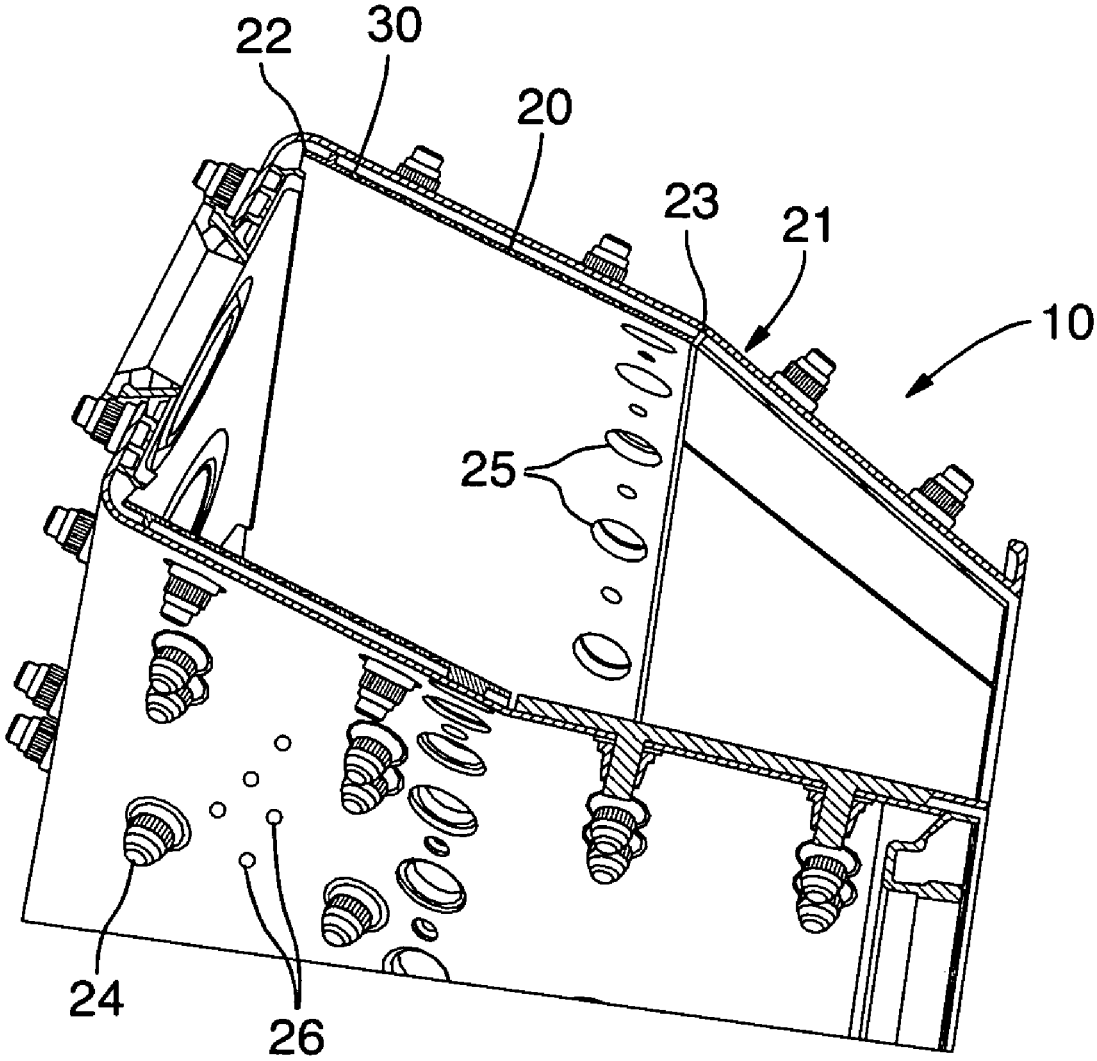
FIG.1 (Prior Art)
FIG. 1 shows an isometric cut-away view of a prior art combustor of a gas turbine engine.

FIG. 1 illustrates a portion of a gas turbine engine having a combustor 10 with floatwall panels 20. The combustor 10 has an outer shell 21 to which the floatwall panels 20 are attached. The outer shell 21 may be made of a metallic material, and the floatwall panels 20 may be made of a heat-resistant material, such as a metal alloy or a ceramic. Each floatwall panel 20 may be attached to the outer shell 21 using, for example, studs and nuts 24 that are designed to accommodate differences in thermal expansion, as known in the art. In order for cooling air to enter the combustor 10 from the plenum, dilution holes 25 are provided in the floatwall panel 20 and the outer shell 21. First air impingement holes 26 may be provided on the outer shell 21 to allow cooling air from the plenum to enter behind the floatwall panel 20 and provide convective cooling. Note that in FIG. 1, only a few example air impingement holes 26 are shown for simplification. This air is then directed out through the surface effusion holes 30, forming a film of cooling air.

However, because of limited access and space around the side of the dilution hole 25 near the trailing edge 23 of the floatwall panel 20, there is a lack of air impingement and effusion cooling in this area. As a result, the floatwall panel 20 tends to get very hot in this area and suffers thermal damage, such as cracks and rapid oxidization.

Figure 2:
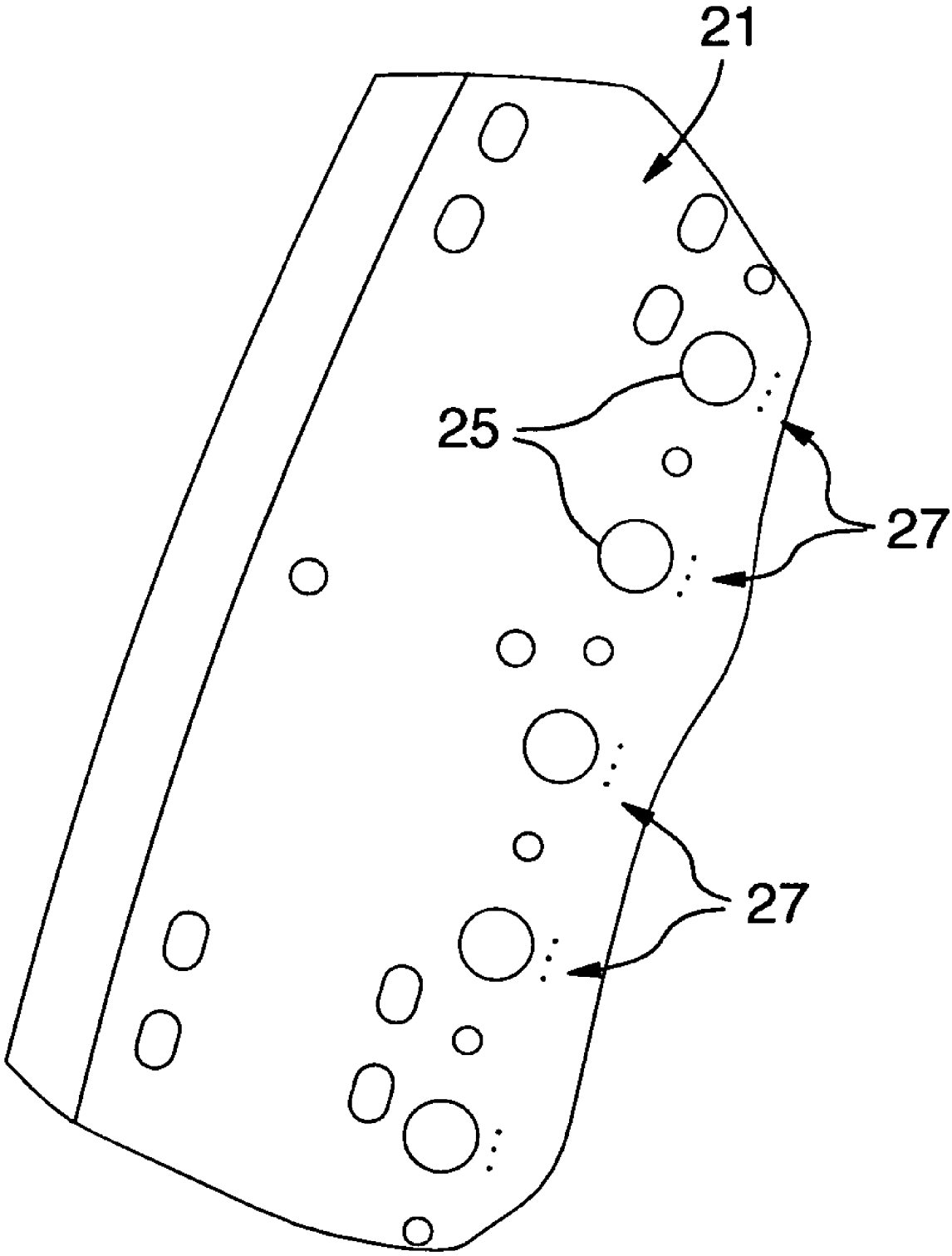
FIG. 2 is an isometric view of a section of a combustor outer shell in accordance with one embodiment of the present invention.
Figure 3:
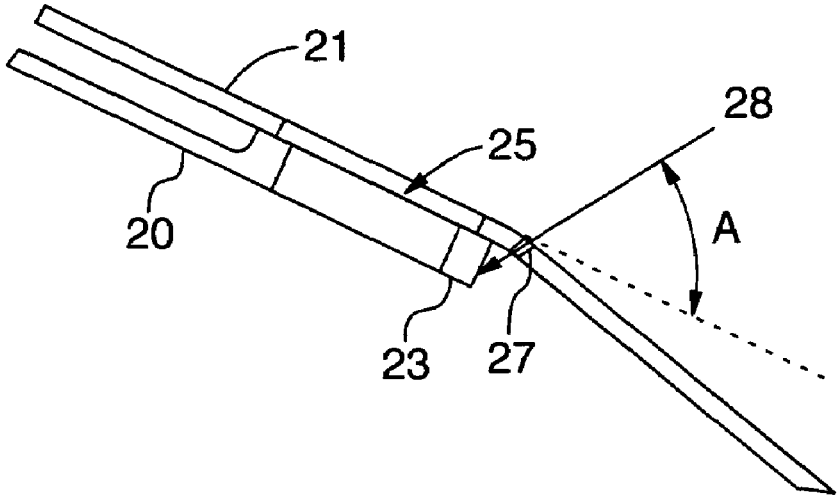
FIG. 3 is a cross-section through a section of a combustor in accordance with one embodiment of the present invention.

In one embodiment of the present invention, as shown in FIGS. 2 and 3, the above problem can be addressed by purging the hot gas from the space behind the floatwall panel 20, and by directing cooling air to impinge on the trailing edge 23. This is accomplished by providing at least one local air impingement hole 27 in the outer shell 21, downstream of the dilution hole 25. The local air impingement hole 27 directs cooling air at the trailing edge 23 of the floatwall panel 20, as shown by arrow 28. The cooling air impinges against the trailing edge 23, thus purging hot gas trapped behind the floatwall panel 20 and cooling the trailing edge 23. For simplicity, first impingement holes 26 are not shown in these figures, however they may be present, as described above with respect to FIG. 1.

Preferably, there is a plurality of local air impingement holes 27 grouped behind each dilution hole 25. With reference to FIG. 3, the local air impingement holes 27 are preferably at an angle A, directed towards the trailing edge 23. More preferably, there are three local air impingement holes 27 behind each dilution hole 25, and the local air impingement holes 27 are preferably at an angle of 60° from the plane of the outer shell 21. The local air impingement holes 27 may be arranged in any suitable cooling hole pattern, as known to those skilled in the art. In one embodiment, three local air impingement holes 27 are arranged in a line downstream of the dilution hole 25.

In one embodiment, the local air impingement holes 27 are located at a minimum distance of about 0.010 inches (as measured along the inner side of the outer shell 21) from the trailing edge 23 of the floatwall panel 20. Preferably, the local air impingement holes 27 have smaller diameters than the dilution holes 25, and may be similar in size to the first air impingement holes 26. A person skilled in the art would know to select a size that is large enough to provide effective cooling, but not so large that the local air impingement hole 27 negatively affects the structural integrity of the outer shell 21.

Figure 4:
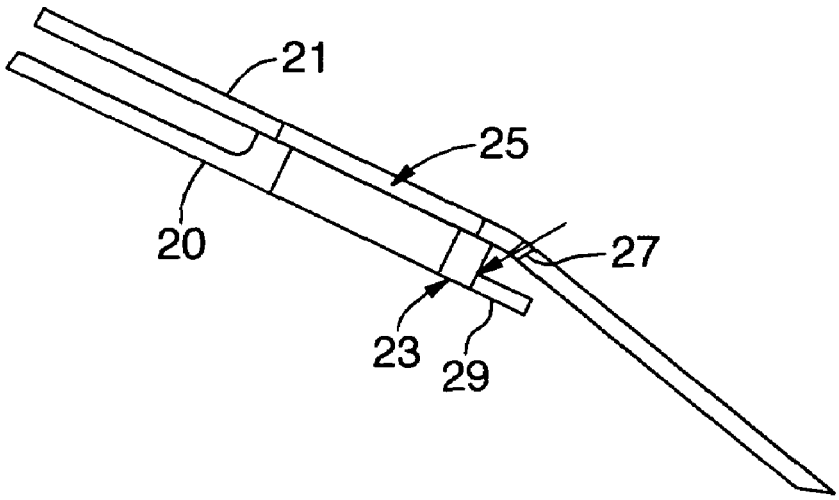
FIG. 4 is a cross-section through a section of a combustor in another embodiment of the present invention.

In another embodiment of the present invention, shown in FIG. 4, the trailing edge 23 of the floatwall panel 20 is further provided with a louver 29 extending over the local air impingement hole 27. The louver 29 captures the impinged air and directs it downstream over the surface of the next downstream panel (not shown). This aids in maintaining the film of cool air inside the combustor 10 that serves to cool the next downstream panel. Further the louver 29 acts as a heat sink to draw heat from upstream areas of the panel.

Although the above description relates to a specific preferred embodiment as presently contemplated by the inventor, it will be understood that the invention in its broad aspect includes mechanical and functional equivalents of the elements described herein.

We claim:

1. A gas turbine combustor, within a plenum containing pressurized cooling air at a plenum pressure, the combustor comprising:

an outer shell having an outer surface exposed to the pressurized cooling air and an inner surface exposed to combustion gases at a pressure lower than the plenum pressure;

at least one floatwall panel, the floatwall panel attached to the inner surface of the outer shell and having a trailing edge having a downstream facing surface;

at least one dilution hole in the floatwall panel near the trailing edge and in communication with the outer surface of the outer shell; and at least one local air impingement hole in the outer shell downstream of each at least one dilution hole and of the trailing edge downstream facing surface, directing the pressurized cooling air through the outer shell directly from the plenum at about the plenum pressure only at the downstream facing surface of the trailing edge of the floatwall panel, without the pressurized cooling air passing through any other passage other than the at least one local air impingement hole.

2. The combustor of claim 1 wherein the local impingement hole is oriented at an angle relative to the outer shell in an axial plane towards the trailing edge of the floatwall panel.

3. The combustor of claim 2 wherein the local impingement hole is disposed at an angle of 60°.

4. The combustor of claim 1 wherein the local impingement hole is located at least 0.010 inches from the trailing edge, as measured along the inner surface of the outer shell.

5. The combustor of claim 1 wherein there are at least three local impingement holes downstream of each at least one dilution hole.

6. The combustor of claim 1 wherein the trailing edge of the floatwall panel has an extension over the at least one local impingement hole.

7. A gas turbine engine having a combustor, within a plenum containing pressurized cooling air at a plenum pressure, the combustor comprising:

an outer shell having an outer surface exposed to the pressurized cooling air and an inner surface exposed to combustion gases at a pressure lower than the plenum pressure;

at least one floatwall panel, the floatwall panel attached to the inner surface of the outer shell and having a trailing edge having a downstream facing surface;

at least one dilution hole in the floatwall panel near the trailing edge and in communication with the outer surface of the outer shell; and at least one local air impingement hole in the outer shell downstream of each at least one dilution hole and of the trailing edge downstream facing surface, directing the pressurized cooling air through the outer shell directly from the plenum at about the plenum pressure only at the downstream facing surface of the trailing edge of the floatwall panel, without the pressurized cooling air passing through any other passage other than the at least one local air impingement hole.

8. The gas turbine engine of claim 7 wherein the local impingement hole is oriented at an angle relative to the outer shell in an axial plane towards the trailing edge of the floatwall panel.

9. The gas turbine engine of claim 8 wherein the local impingement hole is disposed at an angle of 60°.

10. The gas turbine engine of claim 7 wherein the local impingement hole is located at least 0.010 inches from the trailing edge, as measured along the inner surface of the outer shell.

11. The gas turbine engine of claim 7 wherein there are at least three local impingement holes downstream of each at least one dilution hole.

12. The gas turbine engine of claim 7 wherein the trailing edge of the floatwall panel has an extension over the at least one local impingement hole.

* * * * *